US007785233B1

(12) United States Patent
Moore

(10) Patent No.: US 7,785,233 B1
(45) Date of Patent: Aug. 31, 2010

(54) COLLAPSIBLE HURDLE WITH QUICK RESET

(76) Inventor: Thomas M. Moore, 2093 Lamplight Cir., Woodbury, MN (US) 55125

( * ) Notice: Subject to any disclaimer, the term of this patent is extended or adjusted under 35 U.S.C. 154(b) by 139 days.

(21) Appl. No.: 12/012,474

(22) Filed: Feb. 1, 2008

Related U.S. Application Data

(60) Provisional application No. 60/900,057, filed on Feb. 7, 2007.

(51) Int. Cl.
*A63B 5/16* (2006.01)

(52) U.S. Cl. ..... 482/15; 482/17

(58) Field of Classification Search ..... 482/14, 482/15, 23, 34, 35, 17
See application file for complete search history.

(56) References Cited

U.S. PATENT DOCUMENTS 622,810 A * 4/1899 Peak ..... 139/142
2,583,786 A * 1/1952 Marzucco ..... 482/17
3,384,367 A * 5/1968 Baum ..... 482/17
4,749,187 A * 6/1988 Dellinger et al. ..... 482/17
4,804,064 A * 2/1989 Coultrup et al. ..... 182/155
5,352,057 A 10/1994 Zody
5,776,039 A * 7/1998 Perez, Jr. ..... 482/97

OTHER PUBLICATIONS

Photograph of Smart-Hurdle with foldable feet (undated but admitted prior art based on information and belief).

* cited by examiner

*Primary Examiner*—Jerome Donnelly
(74) *Attorney, Agent, or Firm*—James W. Miller

(57) ABSTRACT

A hurdle has a crossbar and a pair of vertical legs. The hurdle is designed to give way or collapse when the crossbar is struck by a user to minimize the risk of injury and thereby decrease the user's fear of injury. This is done either by splitting the crossbar into separate left and right sections, or by splitting each of the legs into separate top and bottom sections. This permits the separate sections to break apart from an aligned, end-to-end orientation which they possess in an operative position of the hurdle into a nonaligned orientation after the hurdle has given way or collapsed. An elastic member connects the separate sections and urges the sections back into their aligned, end-to-end orientation when a user picks the sections of the hurdle up and resets the hurdle.

16 Claims, 7 Drawing Sheets

COLLAPSIBLE HURDLE WITH QUICK RESET

CROSS REFERENCE TO RELATED APPLICATIONS

This application claims the benefit of one or more previously filed copending provisional applications identified as follows: Application Ser. No. 60/900,057 filed Feb. 7, 2007.

TECHNICAL FIELD

This invention relates to a hurdle that a person runs or jumps over during various athletic activities, such as track events known as the high or low hurdles. More particularly, this invention relates to a hurdle that gives way or collapses easily when it is struck or fallen on by a person attempting to clear the hurdle but that can also be quickly and easily reset.

BACKGROUND OF THE INVENTION

Track and field is a part of the physical education programs of many high schools, junior high schools and elementary schools. Most children seem to enjoy all the track events, including hurdle training and races. However, some children are anxious when attempting to go over standard track hurdles. This anxiety arises because of the inherent danger associated with any object, such as a hurdle, that has the potential to trip them up, causing them to fall.

Some light weight adjustable hurdles have been used to address this issue, but the risk is still there for some students. The goal of hurdling is to run as close to top speed as possible and leap over the hurdles. However, known hurdles do not typically give way or break apart easily. Since this is known to many users, trying to leap over the standard hurdles of the type known in the prior art is still an anxiety producing event due to the fear of injury. It would be an advance in the art to provide a hurdle that easily gives way or comes apart when struck or fallen on by a user. If the athlete or physical education student was aware that the hurdle would give way easily, he or she would be far more likely to aggressively attack the hurdle at top speed, thus more quickly improving his or her hurdling ability.

However, once the hurdle gives way or breaks apart to thereby prevent injury to the person who has struck it, the hurdle must obviously be reset or reassembled before it can be used again. When younger children or relatively unskilled runners are using hurdles, it is common for them to frequently strike and knock a hurdle over. This means that someone, often a coach or teacher, must frequently reset or reassemble the hurdle. If this is an onerous or time consuming task, such as might happen if the hurdle splits into separate, disparate parts that must be individually picked up off the ground and put back together, then the time required for the task is a disincentive to the use of such a hurdle. Thus, there is a clear need in the art for a hurdle that easily gives way in some fashion to prevent injury and thereby decrease the user's fear of injury, but that is also easy and quick to reset.

SUMMARY OF THE INVENTION

One aspect of this invention relates to a hurdle which comprises a plurality of elongated members. The members comprise a substantially horizontal crossbar and a plurality of substantially vertical legs that support the crossbar. At least one of the elongated members is split into separate sections that are disposed in an aligned, end-to-end orientation when the hurdle is in an operative position and that are disposed in a nonaligned, end-to-end orientation when the hurdle is in an inoperative position. An elastic member connects and bridges between the separate sections of the split elongated member. The elastic member applies a force to the separate sections that biases the separate sections in a direction urging the separate sections back into their aligned, end-to-end orientation.

Another aspect of this invention relates to a hurdle which comprises a substantially horizontal crossbar supported by a pair of laterally spaced legs. At least one component from a group of components comprising the crossbar and legs separates into separate sections when the crossbar is struck by a user who is attempting to clear the crossbar to permit the hurdle to give way or collapse to minimize the risk of injury to the user. A flexible member keeps the separate sections at least loosely joined together after the hurdle has given way or collapsed to prevent the user from having to collect completely disconnected sections from the ground to reset the hurdle.

Yet another aspect of this invention relates to a hurdle which comprises a crossbar and a pair of vertical legs that are designed to at least partially give way or collapse downwardly when the crossbar is struck by a user to minimize the risk of injury and thereby decrease the user's fear of injury. Either the crossbar is split into separate left and right sections or each of the legs is split into separate top and bottom sections. The separate sections of the crossbar or the legs break apart from an aligned, end-to-end orientation which they possess in an operative position of the hurdle into a nonaligned, end-to-end orientation after the hurdle has given way or collapsed downwardly. A member is provided for biasing the separate sections of the crossbar or the legs back into their aligned, end-to-end orientation when a user pulls the separate sections of the hurdle upwardly to reset the hurdle.

BRIEF DESCRIPTION OF THE DRAWINGS

This invention will be described more completely in the following Detailed Description, when taken in conjunction with the following drawings, in which like reference numerals refer to like elements throughout.

DETAILED DESCRIPTION

Figure 1:
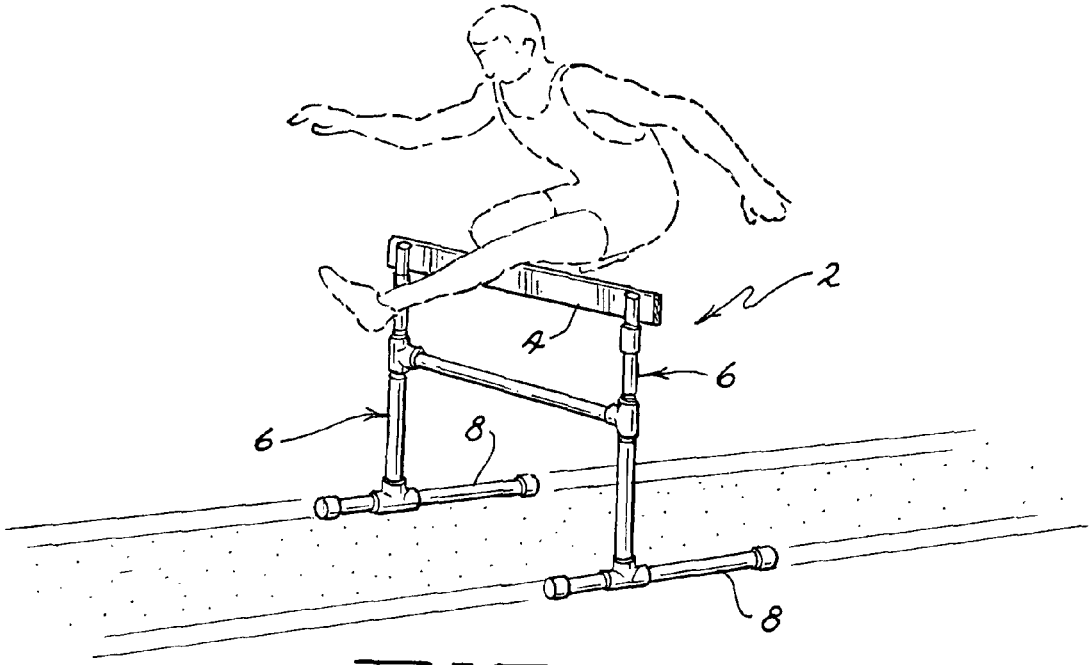
FIG. 1 is a perspective view of a first embodiment of a hurdle according to this invention, particularly illustrating a runner who is leaping over the hurdle with the hurdle being shown in an operative position.

A first embodiment of a hurdle according to this invention is illustrated generally as 2 in FIG. 1. Hurdle 2 comprises a substantially horizontal, laterally extending crossbar 4 supported above the ground by a pair of vertically extending uprights or legs 6. Legs 6 are laterally spaced apart with each leg 6 supporting one end of crossbar 4. The lower ends of legs 6 have horizontal ground engaging feet 8 that support hurdle 2 in an upright operative position as shown in FIG. 1.

Figure 2:
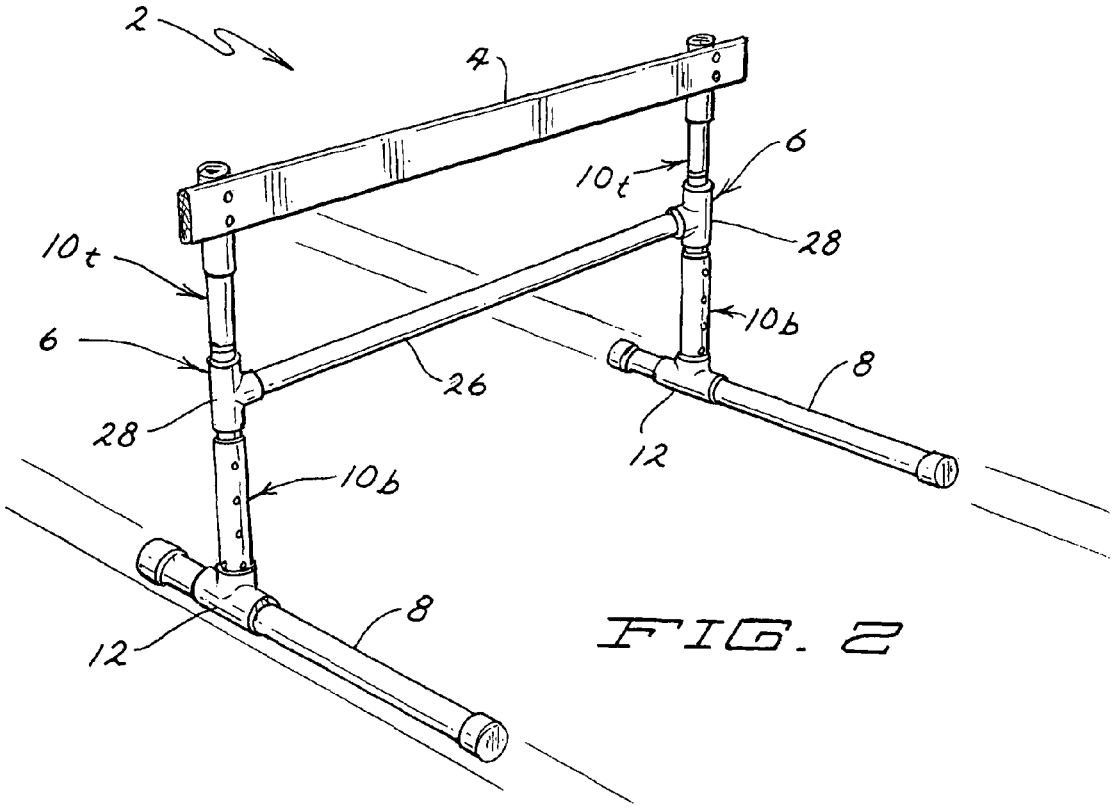
FIG. 2 is a larger perspective view of the hurdle of FIG. 1, particularly illustrating the hurdle by itself with the hurdle being shown in an operative position.

When hurdle 2 is in the operative position shown in FIGS. 1 and 2, feet 8 at the lower ends of legs 6 extend perpendicularly to crossbar 4 for a short distance to either side of crossbar 4 so that hurdle 2 is self supporting. When hurdle 2 is in the operative position, legs 6 also extend vertically straight upwardly and downwardly. Crossbar 4 is located at the top of legs 6 in a substantially horizontal orientation. Crossbar 4 is approximately 40" wide though this can be lengthened or shortened as desired. A user can attempt to hurdle or leap over hurdle 2 as shown in FIG. 1. If the user is successful, he or she will clear crossbar 4 of hurdle 2 without firmly striking or hitting crossbar 4 or falling onto crossbar 4.

Legs 6 of crossbar 4 are split into separate top and bottom sections 10*t* and 10*b* thereof. Preferably, leg sections 10 comprise hollow, cylindrical sections of pipe or conduit, such as 1" or 1¼" PVC pipe. Similarly, ground engaging feet 8 are also made from similar sections of pipe or conduit. Each leg bottom section 10*b* carries one ground engaging foot 8 of hurdle 2 in a T-shaped fitting 12.

Preferably, each leg bottom section 10*b* is variable in length to allow the height of crossbar 4 above the ground to be adjusted. Each leg bottom section 10*b* comprises inner and outer, concentric, telescopic portions 14*i* and 14*o*. Outer portion 14*o* includes a plurality of vertically spaced height adjustment holes 16 spaced along the length thereof. Inner portion 14*i* vertically telescopes into and out of outer portion 14*o* to vary the effective length of leg bottom section 10*b*.

Inner portion 14*i* carries a spring lock 18 inside the hollow interior of inner portion 14*i*. Spring lock 18 used inside inner portion 14*i* is not completely shown in FIGS. 1-5, but is shown in conjunction with a second embodiment of the hurdle of this invention depicted in FIGS. 6-9. Accordingly, reference will now be had to FIG. 9 to illustrate and describe spring lock 18 since spring lock 18 depicted in FIG. 9 is the same as spring lock 18 used inside inner portion 14*i*.

Figure 9:
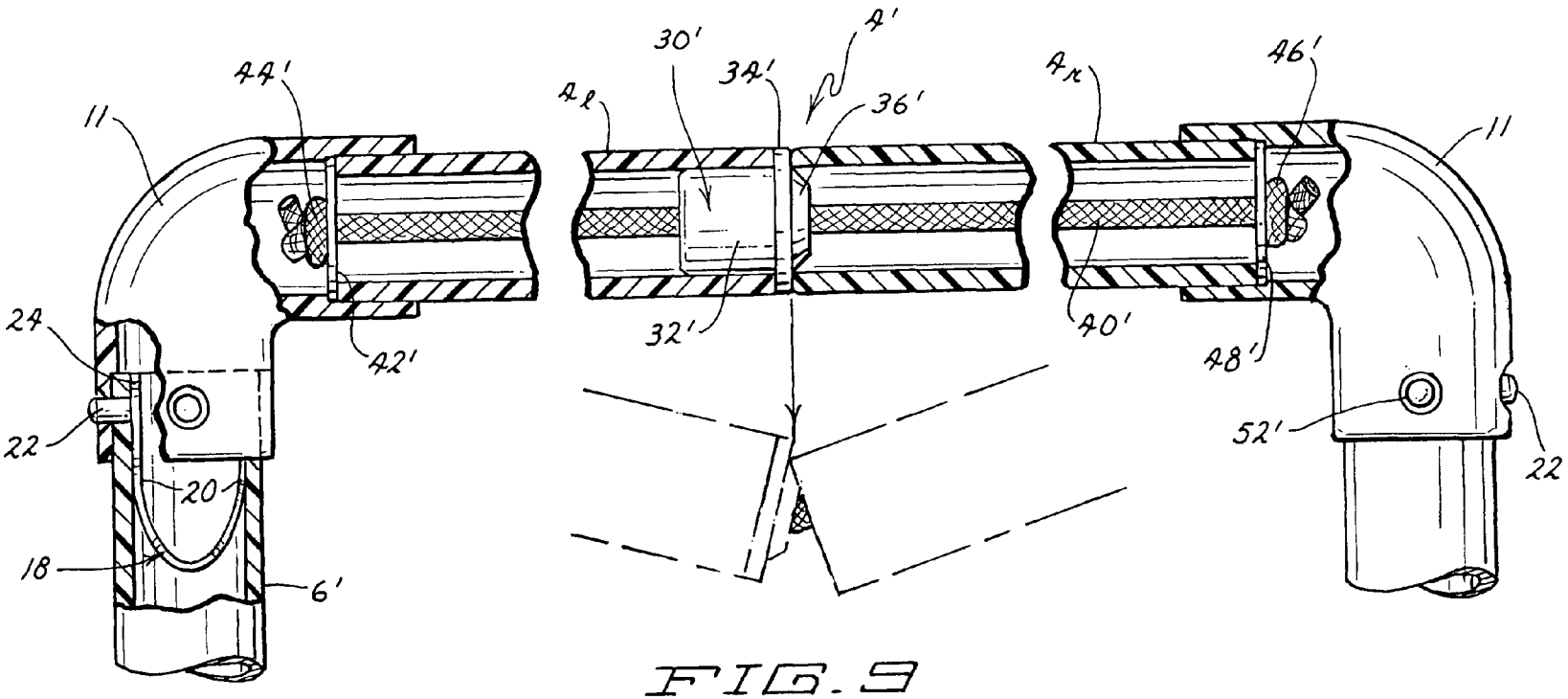
FIG. 9 is a cross-sectional view through the crossbar of the hurdle of FIG. 6, particularly illustrating an elastic member that is configured to hold the left and right sections of the crossbar together in an aligned end-to-end orientation when the hurdle is in the operative position but which permits the left and right sections of the crossbar to split apart into a nonaligned end-to-end orientation when the hurdle is struck by the user and gives way or collapses into an inoperative position.

Referring now to FIG. 9, spring lock 18 has a simple U or V-shape provided by a pair of spaced legs 20. An outwardly protruding locking tab 22 is carried at the free end of one leg 20. As can be seen in FIG. 9, legs 20 of spring lock 18 can be partially squeezed or compressed together to allow spring lock 18 to be inserted into the interior of a hollow cylindrical member, such as inner portion 14*i*. Following such insertion, legs 20 of spring lock 18, and locking tab 22 carried on one leg 22, are biased radially outwardly as legs 20 try and relieve the compression they are under. A hole 24 is provided in the sidewall of the cylindrical member in which spring lock 18 is received. Locking tab 22 will extend out through hole 24 under the bias provided by legs 20 of spring lock 18. Spring lock 18 can be a Valco A-140 snap button or similar device.

As noted earlier, a spring lock 18 of this type is carried at the lower end of inner portion 14*i*. When so carried, locking tab 22 extends out through a hole (not shown but similar to hole 24) provided in the lower end of inner portion 14*i*. Tab 22 is long enough to also extend through one of the height adjustment holes 16 provided in outer portion 14*o* of leg bottom section 10*b*. This locks the telescoping inner and outer portions 14*i* and 14*o* of leg bottom section 10*b* together at some desired adjusted height.

Figure 3:
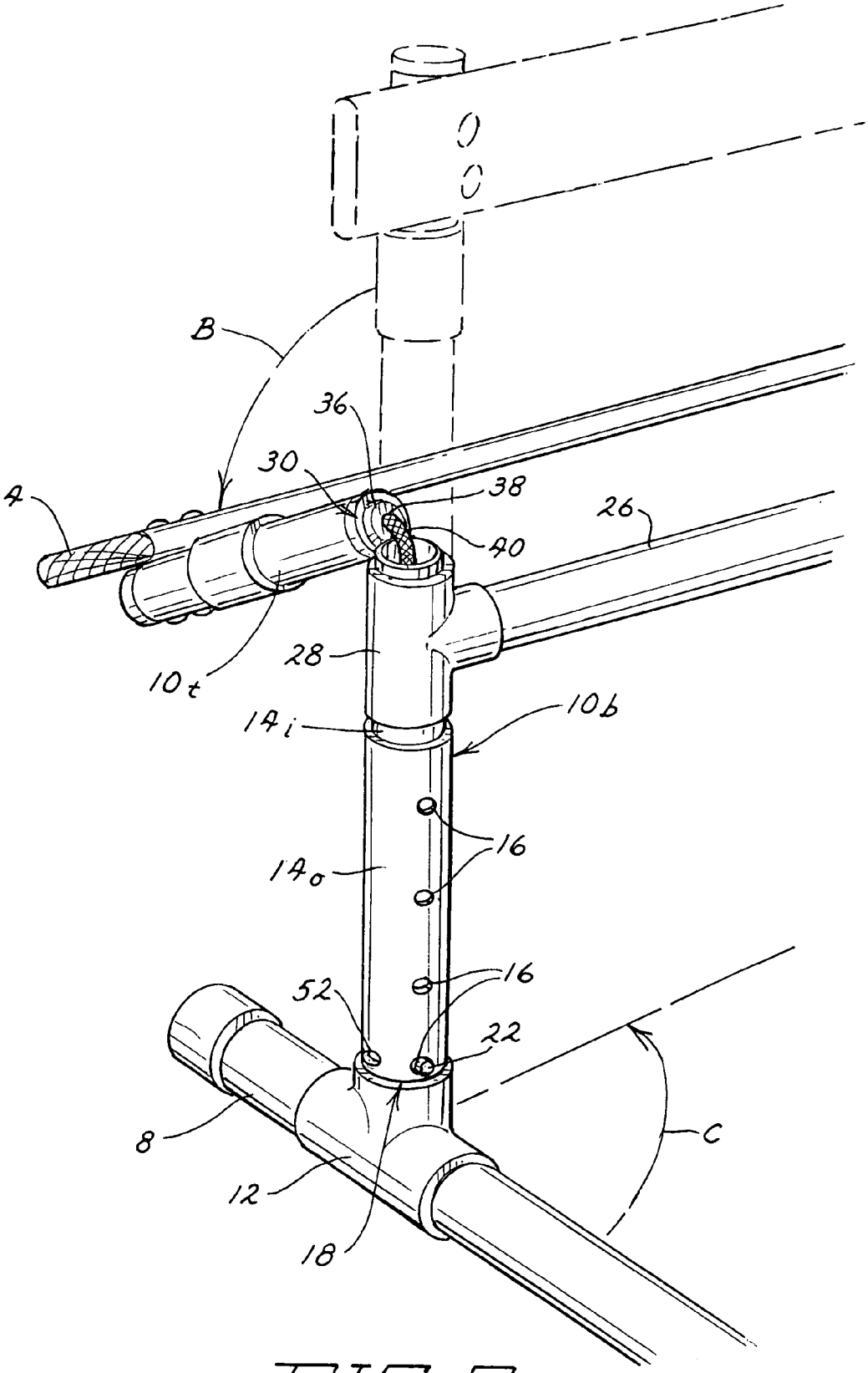
FIG. 3 is an enlarged perspective view of a section of the hurdle of FIG. 1, particularly illustrating the hurdle in an inoperative position in which the hurdle has given way or collapsed after being struck by a user.

As shown in FIG. 3, locking tab 22 of spring lock 18 inside inner portion 14*i* is engaged in the lowest height adjustment hole 16 in outer portion 14*o*. This locks inner and outer portions 14*i* and 14*o* of leg bottom section 10*b* together in their shortest or minimum height configuration. The height of hurdle 2 can be raised by pushing inwardly on tab 22 until it disengages the lowest hole 16 thereby unlocking spring lock 18, by then pulling up on inner portion 14*i* of leg bottom section 10*b* until locking tab 22 of spring lock 18 is adjacent one of the other, higher holes 16, and by then stopping the upward movement of inner portion 14*i* to let locking tab 22 of spring lock 18 pop out into the selected higher hole 16. Obviously, the height of hurdle 2 can be lowered by moving tab 22 from a higher hole 16 to a lower hole 16. Inner and outer portions 14*i* and 14*o* of leg bottom section 10*b* can be keyed to one another to prevent relative rotation and to keep tab 22 on spring lock 18 aligned with the line of locking holes 16, but this key would still permit vertical telescoping motion between inner and outer portions 14*i* and 14*o*.

Inner portions 14*i* of leg bottom sections 10*b* of legs 6 are preferably joined or united together by a transverse cross brace 26. Hurdle 2 will be more stable in use with brace 26 in place. However, brace 26 could be deleted if so desired. Brace 26 is also a cylindrical pipe or conduit connected to T-shaped fittings 28 provided on inner portion 14*i* of each leg bottom section 19*b* or each leg 6.

Leg bottom sections 10*b* of legs 6 could be made as single pieces that do not have telescoping inner and outer portions 14*i* and 14*o* and that are not adjustable in height. Thus, while a height adjustable hurdle of the type shown herein is preferred, hurdle 2 of this invention can also be formed as a fixed height hurdle.

Leg top section 10*t* fits or mates in an aligned end-to-end manner with leg bottom section 10*b* when hurdle 2 is in the operative position thereof as shown in FIGS. 1 and 2. In other words, leg top section 10*t* is positioned atop leg bottom section 10*b* and extends in a vertically straight line relative thereto.

A guide 30 is inserted into the lower end of leg top section 10*t*. Guide 30 includes a cylindrical body 32 that sticks up into leg top section 10*t* for a short distance. Guide 30 also includes an enlarged, washer like flange 34 that abuts against the lower end of leg top section 10*t*. Finally, guide 30 includes a shorter, chamfered guide section 36. Guide 30 can be made of various materials, but the use of plastic is preferred.

Figure 4:
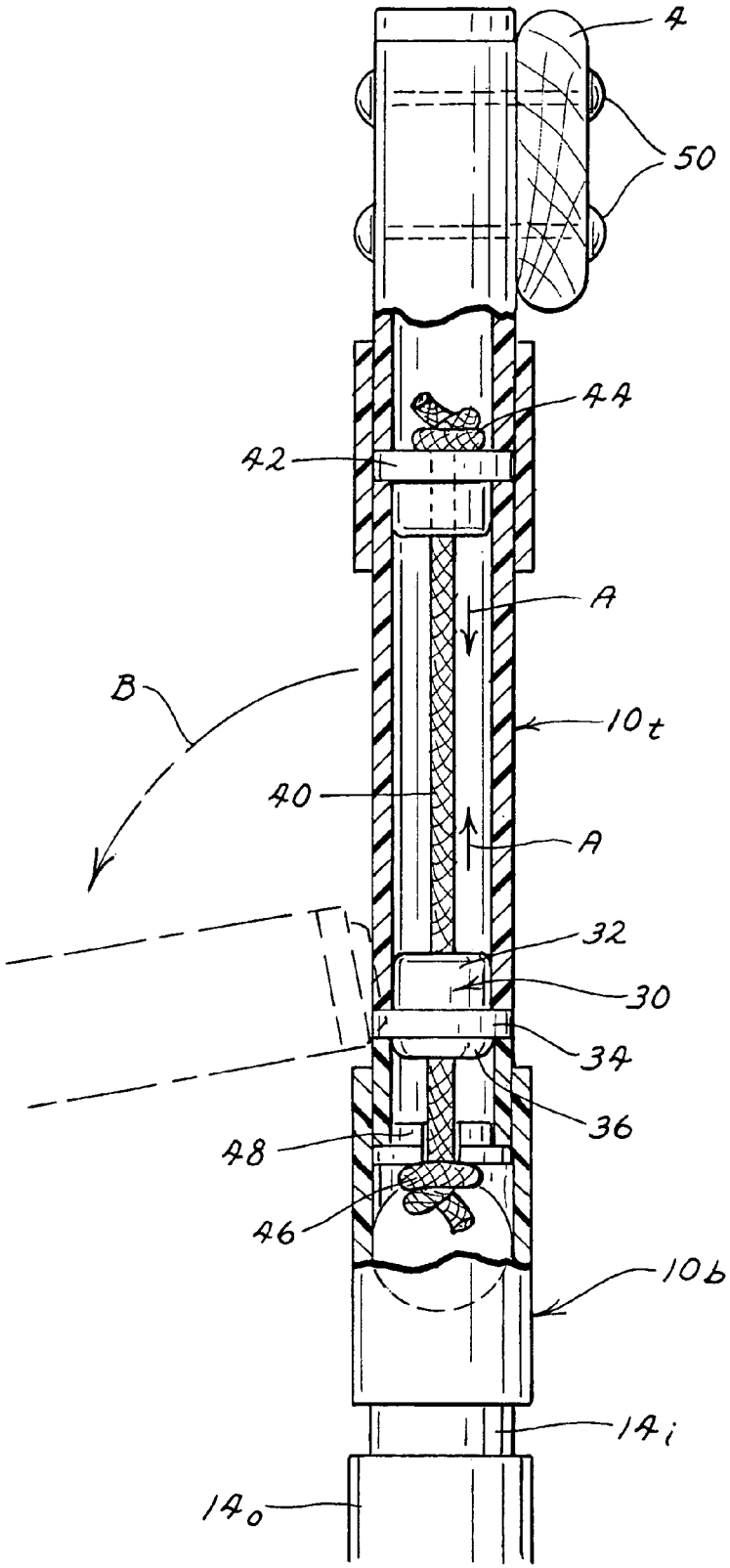
FIG. 4 is a cross-sectional view through one of the vertical legs of the hurdle of FIG. 1, particularly illustrating an elastic member that holds separate upper and lower sections of the leg together in an aligned end-to-end orientation when the hurdle is in the operative position but which permits the upper and lower sections of the leg to split apart into a nonaligned end-to-end orientation when the hurdle is struck by the user and gives way or collapses into an inoperative position.

When leg top section 10*t* is in its aligned end-to-end orientation with leg bottom section 10*b*, guide 30 is disposed as shown in FIG. 4. Cylindrical body 32 of guide 30 is received inside leg top section 10*t*, washer like flange 34 of guide 30 is sandwiched between the top and bottom sections 10*t* and 10*b* of leg 6, and chamfered guide section 36 is inserted into leg bottom section 10*b*. Guide 30 need not be rigidly fixed or connected to leg top section 10*t* but can be press fit into leg top section 10*t*. However, guide 30 could be rigidly fixed or carried on leg top section 10*t* if so desired. In addition, the orientation of guide 30 could be inverted with cylindrical body 32 being received inside leg bottom section 10*b* and chamfered guide section 36 then fitting up into leg top section 10*t*.

An elastic member 40 extends vertically inside leg top section 10*t* and leg bottom section 10*b* and passes through a bore 38 in guide 30. Elastic member 40 can be a bungee cord having an appropriate size, e.g. ⅜" diameter bungee cord. The upper end of elastic member 40 is secured to leg top section 10*t* by a fixed washer 42 in leg top section 10*t*. The upper end of elastic member 40 is retained atop washer 42 by a knot 44 therein. Similarly, the lower end of elastic member 40 is retained inside leg bottom section 10*b* by a knot 46 that is located below a fixed washer 48 in leg bottom section 10*b*. See FIG. 4.

Elastic member 40 has a length that is chosen so that elastic member 40 is under tension when elastic member 40 is received inside top and bottom sections 10*t* and 10*b* of leg 6. In other words, when the ends of elastic member 40 are knotted at 44 and 46 and are retained atop and below the washers 42 and 48, respectively, elastic member 40 is trying to contract, as shown by the arrows A in FIG. 4, to relieve the tension it is under. This applies a force that holds top and bottom sections 10*t* and 10*b* of leg 6 in their aligned end-to-end orientation relative to one another. This is the operative position of hurdle 2. The force of elastic member 40 retains each vertical leg 6 of hurdle 2 in a straight vertically upright orientation with the chamfered guide section 36 of guide 30 extending a short distance downwardly into the upper end of leg bottom section 10*b*.

As can be seen in FIGS. 3 and 4, crossbar 4 of hurdle 2 is rigidly fixed to the upper ends of the top sections 10*t* of the pair of vertical legs 6. While the top and bottom sections 10*t* and 10*b* of legs 6 can be economically and easily manufactured from plastic conduit such as PVC piping as mentioned earlier, crossbar 4 simply comprises a wooden or plastic board or slat that is secured by bolts 50 to the top sections 10*t* of legs 6. Thus, crossbar 4 is rigidly fixed to the top sections 10*t* of legs 6 just as the transverse cross brace 26 was rigidly fixed to the inner portions 14*i* of bottom sections 10*b* of legs 6.

When hurdle 2 is in its operative position as shown in FIG. 1, the split vertical legs 6 of hurdle 2 will have their top and bottom sections 10*t* and 10*b* disposed in an aligned end-to-end orientation relative to each other. If a user happens to strike crossbar 4 with his or her foot, or land atop crossbar 4, crossbar 4 will deflect relative to the rest of hurdle 2 and will give way or collapse into a nonaligned, inoperative position. This is shown in FIG. 3 with the operative position being shown in phantom lines and the inoperative position being shown in solid lines. The impact from the user will pivot or collapse top sections 10*t* of legs 6 relative to lower sections 10*b* of legs 6 as depicted by the arrow B in FIGS. 3 and 4. Thus, crossbar 4 will easily flop over to one side as shown in FIG. 3 or FIG. 4 from the impact with the user's foot. This will dramatically reduce any risk that the user will be injured, stumble or fall.

However, after hurdle 2 has given way or collapsed in this fashion, it is very easy to quickly reset hurdle 2. All someone else has to do is to grab crossbar 4 and pull it back upwardly until top sections 10*t* of legs 6 become realigned with lower sections 10*b* of legs 6. Then, the force provided by elastic member 40 in each leg 6 will cause the split top and bottom sections 10*t* and 10*b* to snap back together into their aligned end-to-end orientation. Chamfered guide section 36 of guide 30 helps guide top section 10*t* of each leg 6 back into its aligned, end-to-end and overlying relationship with each leg bottom section 10*b*. If hurdle 2 does not automatically reset itself after crossbar flops or deflects over, all it takes to reset hurdle 2 is one quick pull upwardly on crossbar 4 of hurdle 2.

Hurdle 2 of this invention has numerous desirable features. Hurdle 2 easily gives way or collapses from its operative position to its inoperative position. All that holds hurdle 2 together is the force provided by the two elastic members 40 along with the slight interference fit provided by the chamfered guide sections 36 of guides 30. Thus, if a user relatively firmly strikes crossbar 4 of hurdle 2 with a foot as opposed to simply brushing crossbar 4 with a foot, crossbar 4 will easily give way with crossbar 4 flopping over to one side. Crossbar 4 flops over to the side simply by virtue of the top and bottom sections 10*t* and 10*b* of each leg 6 becoming nonaligned end-to-end relative to one another.

The fact that hurdle 2 will give way or collapse so easily obviously lessens the risk of any injury to the user. But, beyond this, once the user learns that hurdle 2 gives way or collapses easily, the user can more easily put aside his or her natural fear of injury. This permits the user to attack or run the hurdle 2 more aggressively. This will lead to a faster and more sustained increase in hurdling ability. This is desirable.

Yet, while hurdle 2 easily gives way or collapses into an inoperative position, the top and bottom sections 10*t* and 10*b* of legs 6 are still connected to one another through elastic members 40. Crossbar 4 will not completely disconnect from legs 6. There are no loose or separate parts that one has to find and collect on the ground to reset hurdle 2. All one needs to do to reset hurdle 2 is to simply pull up on crossbar 4 if hurdle 2 has not automatically reset simply from the force of elastic members 40.

The fact that hurdle 2 can be so easily reset will encourage use of hurdle 2. It is not a time consuming or onerous task to reset hurdle 2. The quick and easy manner of resetting hurdle 2, coupled with how quickly and easily it gives way when struck, will be a boon to those involved in training athletes or providing physical education.

Figure 5:
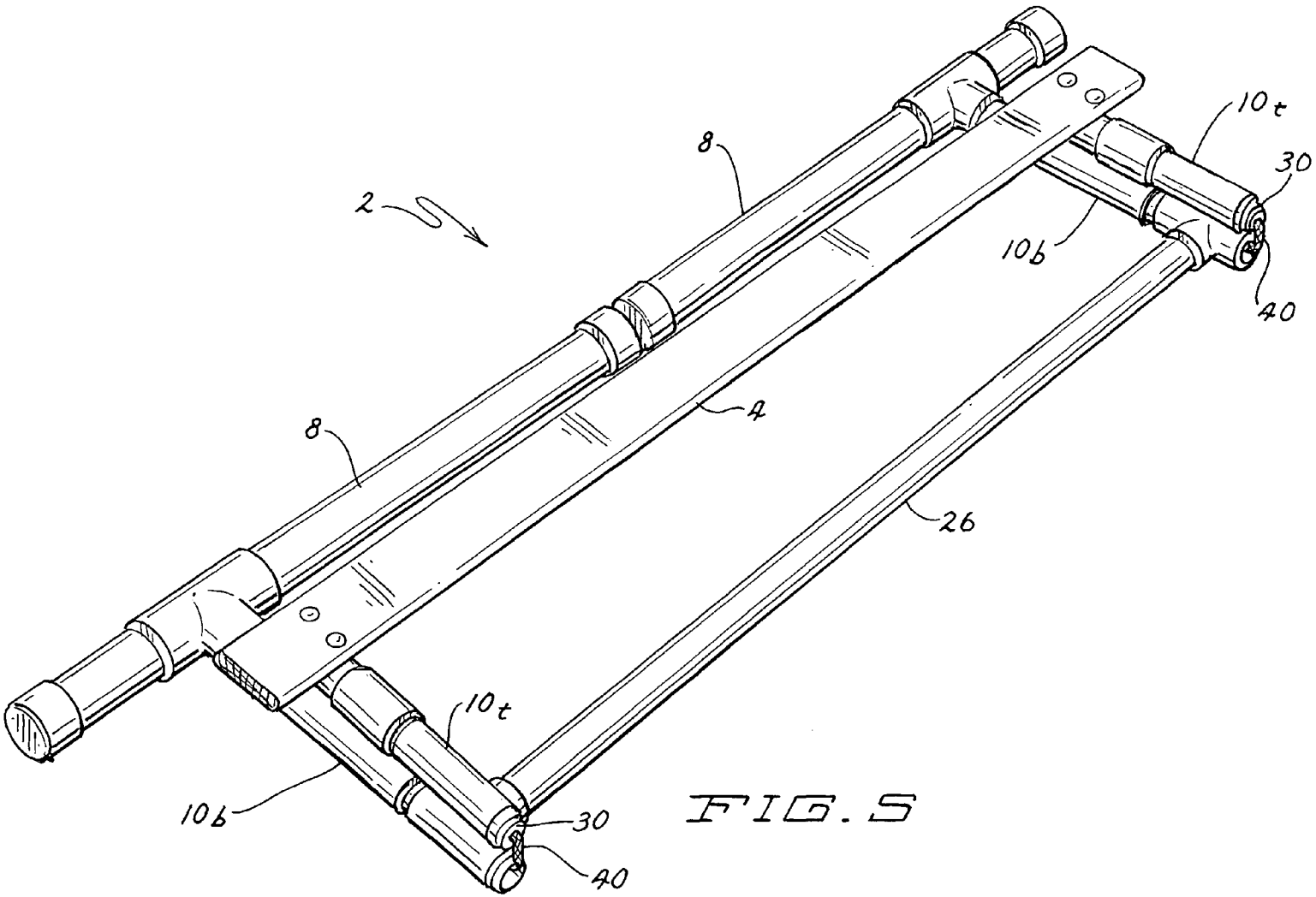
FIG. 5 is a perspective view of the hurdle of FIG. 1, particularly illustrating the hurdle lying on the ground in a folded storage position.

Hurdle 2 also folds into a more compact form for storage. This can be done by intentionally folding the top and bottom sections 10*t* and 10*b* of legs 6 over one another so that top sections 10*t* lie flat against lower sections 10*b* of legs 6 as shown in FIG. 5. However, in the storage position, the top and bottom sections 10*t* and 10*b* of legs 6 can also commonly be left in an unfolded position in which they remain in their aligned end-to-end orientation relative to each other. In addition, in the storage position, outer portions 14*o* of lower sections 10*b* of legs 6 will be rotated 90° relative to inner portions 14*i* as shown by the arrow C in FIG. 3. This repositions the ground engaging feet 8 of hurdle 2, which are rigidly secured or attached to outer portions 14*o* of leg lower sections 10*b*, to be parallel to crossbar 4 rather than being perpendicular. Thus, in the folded storage position of hurdle 2 shown in FIG. 5, ground engaging feet 8 do not extend perpendicularly relative to crossbar 4 and thus hurdle 2 takes up less space.

A locking hole 52 offset 90° from the line of height adjustment holes 16 is provided in outer portion 14*o* of lower section 10*b* of each leg 6. This offset locking hole 52 coacts with spring lock 18 to lock the ground engaging feet 8 in their storage position shown in FIG. 5.

Referring now to FIGS. 6-9, a second embodiment of a hurdle 2' according to this invention comprises a crossbar 4' that is supported at opposite ends by a pair of vertical legs 6'. The lower ends of legs 6' are provided with ground engaging feet 8' received in T-shaped fittings 12'. Legs 6' can range in height from 12'" to 30" to accommodate a wide range of skill levels, ages or activities being performed. Crossbar 4' includes a right angle elbow 11 at either end for receiving the upper end of one vertical leg 6'. The components of hurdle 2' are preferably made from 1" or 1¼ PVC pipe, but other components could be used.

Figure 6:
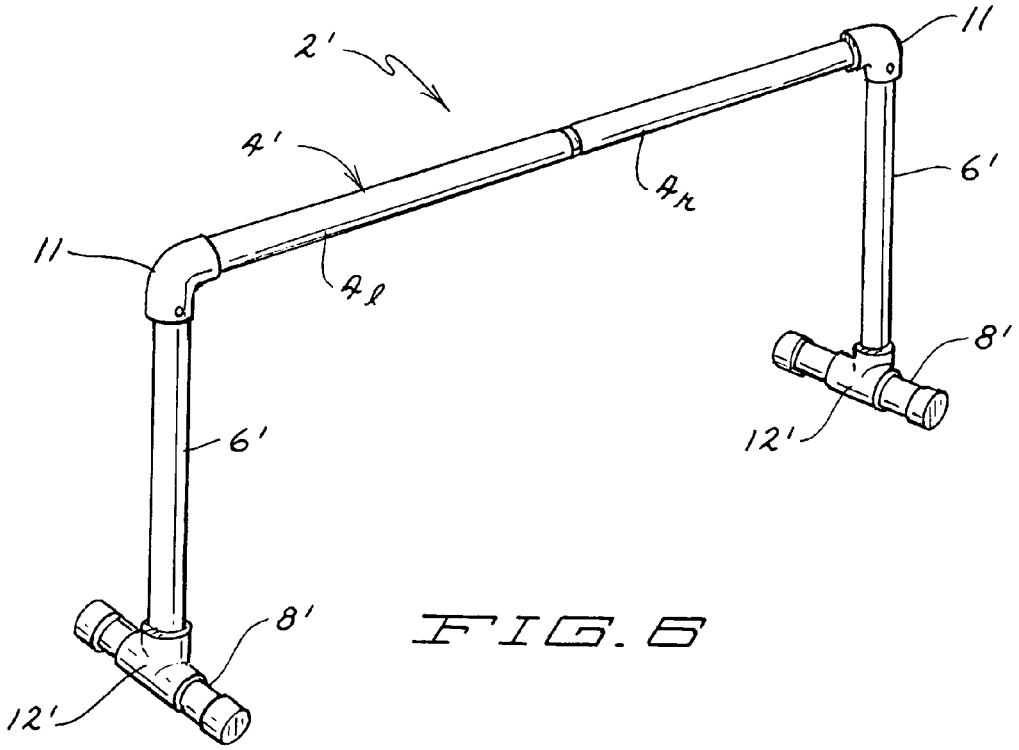
FIG. 6 is a perspective view of a second embodiment of a hurdle according to this invention, particularly illustrating the hurdle in an operative position.

When hurdle 2' is in an operative position as shown in FIG. 6, feet 8' are perpendicular to crossbar 4', extending approximately 5" to either side of the centerline of crossbar 4', to make hurdle 2' self-supporting. This narrow base allows students and athletes to run or jump hurdle 2' from either direction. Many young children will run hurdles in the wrong direction increasing the risk of falling. This feature also creates the opportunity to do activities in which hurdle 2' is approached from both sides, such as side jumps in which the student or athlete jumps side to side over an obstacle. Crossbar 4' is approximately 40" wide though this can be lengthened or shortened as desired.

Crossbar 4' is divided in the middle into two sections, a left section 41 and a right section **4*r*. An elastic member 40' in the form of a bungee cord extends inside of crossbar 4' through the length of crossbar 4' generally between points A and B in FIG. 6 although elastic member 40' does not extend all the way through the right angle elbows 11. Each end of elastic member 40' is anchored against the outer end of the main horizontal bar of each crossbar section 4*l* or 4*r* by a washer 42' or 48' that abuts with the end of the main horizontal bar of crossbar section 4*l* or 4*r*. The corresponding end of elastic member 40' is simply tied or knotted as shown at 44' and 46' to be held against washers 42' or 48' as shown in FIG. 9**.

As in the first embodiment of hurdle 2, when so assembled inside crossbar 4', the length of elastic member 40' is chosen to be less than the distance between the anchoring washers 42' and 48'. Thus, elastic member 40' is under tension and seeks to contract. This contracting force on elastic member 40' applies an inward biasing force to the two crossbar sections **4*l* and 4*r* tending to move the two crossbar sections 4*l* and 4*r*** towards each other to keep them in an aligned end-to-end relationship relative to each other.

Elastic member 40' passes through a central passageway or bore in a plastic guide 30' that is generally identical to guide 30 used in hurdle 2. Guide 30' is used at the junction between the two crossbar sections **4*l* and 4*r*. Elastic member 40' simply passes through guide 30' and is not directly attached thereto, i.e. guide 30' is able to slide over elastic member 40'. Guide 30' has a washer-like flange 34' with a relatively long cylindrical body 32' that slips into the inner end of one crossbar section. The other side of washer-like flange 34' carries a short chamfered guide section 36'. Guide section 36'** slips only a short distance into the inner end of the other crossbar section.

Figure 7:
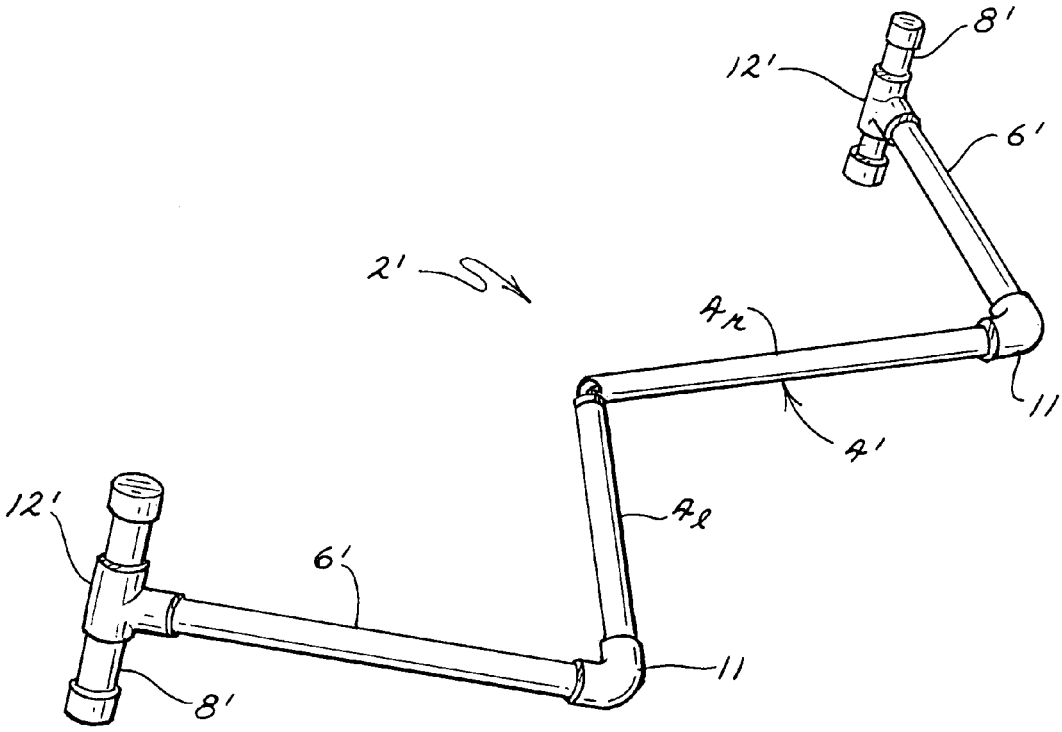
FIG. 7 is a perspective view of the hurdle of FIG. 6, particularly illustrating the hurdle in an inoperative position in which the hurdle has given way or collapsed after being struck by a user with left and right sections of the crossbar having split apart after being struck by the user.
Figure 8:
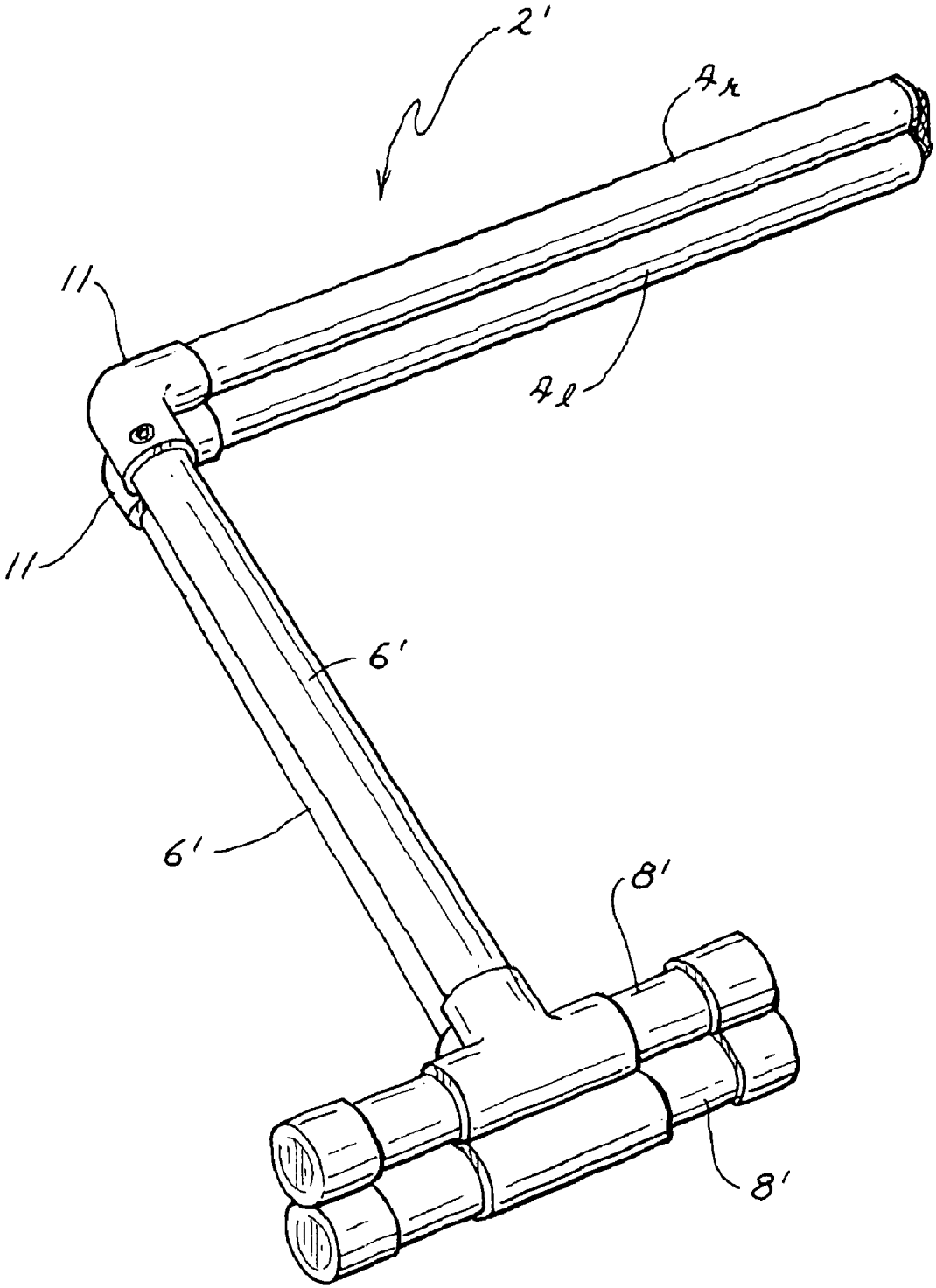
FIG. 8 is a perspective view of the hurdle of FIG. 7, particularly illustrating the hurdle lying on the ground in a folded storage position.

The split design of crossbar 4' allows hurdle 2' to collapse on impact and quickly be reset so the activity can be continued. If a user comes down on top of crossbar 4' or hits crossbar 4' in some other way, crossbar 4' separates into two pieces and collapses down onto the ground as shown in FIG. 7. This avoids injury to the user and increases confidence in using hurdle 2'.

However, hurdle 2' can be quickly and easily reset by users of any age. All the user has to do is to grab one or both of crossbar sections **4*l* and 4*r* and pull them back up until they become generally horizontally aligned with one another. The force of elastic member 40' then helps snap or pull the two sections 4*l* and 4*r* back together. In this regard, the design of guide 30' helps crossbar sections 4*l* and 4*r* to become quickly realigned with each other. Chamfered section 36' self-guides itself back into its crossbar section. Hurdle 2'** can be reset in a matter of seconds even by very young children.

In hurdle 2', each vertical leg 6' connects to an elbow 11 using a spring lock 18 that allows each vertical leg 6' to be turned 90 degrees for storage. See FIG. 8. When not in use for long periods of time, hurdle 2' can be further disassembled with vertical legs 6' eventually being removed from elbows 11 for more compact storage if space is a problem.

FIGS. 6-9 show a fixed height hurdle 2'. However, if so desired, each vertical leg 6' of hurdle 2' could also have a variable length similar to the height adjustment used in legs 6 in hurdle 2 as shown in FIGS. 1-5. An adjustable height hurdle 2' can be adjusted in 2" increments ranging from 12" to 18", 18" to 24", or 24" to 30", and from 30" to 39" with adjustments set at 3" increments.

Hurdles 2 and 2' of this invention take up very little space. If fixed height hurdles are used, a wide range of hurdles of different heights can be easily stored and set up quickly. Being light weight makes it easy for students and younger users to assist with set up and takedown. As students, athletes and coaches desire to increase the height of hurdle they simply pull out a hurdle of a different height, replace vertical leg 6' with one that would be suited to the task being performed or adjust the height on height adjustable models.

Many coaches use a strength building activity often referred to as hurdle hoppers in which the athlete jumps with two feet over a series of hurdles set at a designated height. As mentioned already, hurdles 2 and 2' according to this invention would give way or collapse and drop down if the athlete was to make a mistake, stumble or come down on the hurdle. This reduces the risk of injury and allows the athlete to be more confident in attempting to clear the series of hurdles used for this exercise. Coaches that work with triple jumpers can use different height hurdles to assist the athlete to better perform the three phases of the triple jump. The athlete does not need to be overly concerned when a phase comes up short because hurdles 2 and 2' will give way when struck from the top unlike other hurdles or objects that may be used.

Hurdles 2 and 2' of this invention can also be used for speed development and training athletes to increase stride length with the hurdles set apart at varied distances. Unlike other mini hurdles that do not collapse when stepped on, hurdles 2 and 2' of this invention will give way and allow the athlete to continue and not worry about tripping. Creative coaches and teachers can use hurdles 2 and 2' in any number of ways to help the students/athletes improve speed, quickness, agility and explosive power.

Various modifications of this invention will be apparent to those skilled in the art. For example, the elastic member can take forms other than a bungee cord, such as a rubber band or rubber web or a spring, and can comprise any member that is capable of biasing the split sections **10*t* and 10*b* or 4*l* and 4*r***. Thus, the scope of the invention shall be limited only by the appended claims.

I claim:

1. A hurdle, which comprises:

a) a plurality of elongated members, which comprise:

i) a substantially horizontal crossbar; and ii) a plurality of substantially vertical legs having upper ends that support the crossbar at all times in a stationary manner at a constant height above the ground when the hurdle is being used by a user to perform athletic activities;

b) at least one of the elongated members being split into separate sections that are disposed in an aligned, end-to-end orientation extending in a straight line along a single common axis of elongation when the hurdle is in an operative position and that are disposed in a nonaligned, end-to-end orientation extending along a plurality of different axes of elongation when the hurdle is in an inoperative position such that the separate sections no longer extend in a straight line relative to each other when the hurdle is in the inoperative position, wherein the separate sections are movable from the operative position thereof to the inoperative position thereof during use of the hurdle by inadvertent impact of a foot or other body portion of the user with the crossbar as the user attempts to clear the crossbar by hurdling or jumping over the crossbar; and c) an elastic member connecting and bridging between the separate sections of the split elongated member, the elastic member applying a force to the separate sections that biases the separate sections inwardly towards each other along the common axis of elongation for urging the separate sections back into their aligned, end-to-end orientation.

2. The hurdle of claim 1, wherein the elastic member is a bungee cord.

3. The hurdle of claim 1, wherein the separate sections have ends that abut another in the aligned, end-to-end orientation of the separate sections.

4. A hurdle, which comprises:

(a) a plurality of elongated members, which comprise:

(i) a substantially horizontal crossbar; and (ii) a plurality of substantially vertical legs that support the crossbar;

(b) at least one of the elongated members being split into separate sections that are disposed in an aligned, end-to-end orientation when the hurdle is in an operative position and that are disposed in a nonaligned, end-to-end orientation when the hurdle is in an inoperative position, wherein the separate sections are movable from the operative position thereof to the inoperative position thereof during use of the hurdle by impact of a user with the crossbar as the user attempts to clear the crossbar; and (c) an elastic member connecting and bridging between the separate sections of the split elongated member, the elastic member applying a force to the separate sections that biases the separate sections in a direction urging the separate sections back into their aligned, end-to-end orientation;

(d) wherein the separate sections have ends that abut another in the aligned, end-to-end orientation of the separate sections; and (e) a guide located at the abutting ends of the separate sections to help guide the sections back into their aligned, end-to-end orientation under the influence of the force provided by the elastic member, wherein the guide has a tapered or chamfered guide section that is inserted into a portion of one of the sections as the sections approach their aligned, end-to-end orientation.

5. The hurdle of claim 4, wherein the abutting ends of the sections comprise hollow tubes, and wherein the guide has a body carried inside the hollow tube comprising the abutting end of one section with the guide section of the guide being inserted into the hollow tube comprising the abutting end of the other section as the sections finish their movement to their aligned, end-to-end orientation.

6. The hurdle of claim 5, wherein the guide includes an enlarged, washer like flange with the body of the guide projecting in one direction from one side of the flange and the guide section projecting in an opposite direction from an opposite side of the flange, and wherein the flange is sandwiched between the abutting ends of the sections when the sections are disposed in their aligned, end-to-end orientation.

7. The hurdle of claim 5, wherein the elastic member passes through the guide.

8. The hurdle of claim 7, wherein the elastic member has opposite ends which are anchored to the sections of the split elongated member on opposite sides of the guide.

9. The hurdle of claim 1, wherein each of the vertical legs comprises a split elongated member as recited in claim 1, wherein the separate sections of each split vertical leg comprises a top section and a bottom section, and wherein an elastic member as recited in claim 1 is provided on at least one of the split vertical legs.

10. The hurdle of claim 9, wherein an elastic member as recited in claim 1 is provided on each of the split vertical legs.

11. The hurdle of claim 9, wherein the bottom sections of the split vertical legs carry ground engaging feet that make the hurdle self supporting on the ground, the ground engaging feet extending substantially perpendicularly relative to the crossbar in the operative position of the hurdle.

12. The hurdle of claim 11, wherein the ground engaging feet can be disposed in a storage position in which the ground engaging feet are parallel to the crossbar.

13. The hurdle of claim 12, wherein the vertical legs can be folded into a storage position by pivoting the top sections of the vertical legs into an overlying position relative to the bottom sections of the vertical legs.

14. The hurdle of claim 9, wherein the vertical legs have a variable length to adjust the constant height at which the crossbar can be positioned above the ground.

15. The hurdle of claim 1, wherein the at least one split elongated member comprises the crossbar.

16. A hurdle, which comprises:

a) a substantially horizontal crossbar supported by a pair of laterally spaced substantially vertical legs;

b) wherein each of the legs physically separates and breaks apart into separate disassembled sections when the crossbar is struck by a user who is attempting to clear the crossbar to permit the hurdle to at least partially give way or collapse downwardly to minimize the risk of injury to the user; and c) wherein a flexible member is provided on each of the legs to keep the separate sections of each of the legs loosely joined together after the hurdle has given way or collapsed to prevent the user from having to collect completely disconnected sections from the ground to reset the hurdle, and wherein the flexible member applies a biasing force to the separate sections that moves the separate sections of the legs vertically towards one another to reassemble the separate sections of the legs together when the separate sections are at least partially manually vertically realigned with one another by the user as the user resets the hurdle.

* * * * *